US009344782B2

(12) United States Patent
Davis

(10) Patent No.: US 9,344,782 B2
(45) Date of Patent: May 17, 2016

(54) SUPPLEMENTARY EARPIECE FOR MOVING DISPLAY

(71) Applicant: Google Technology Holdings LLC, Mountain View, CA (US)

(72) Inventor: Giles T. Davis, Mundelein (IL)

(73) Assignee: Google Technology Holdings LLC, Mountain View, CA (US)

( * ) Notice: Subject to any disclaimer, the term of this patent is extended or adjusted under 35 U.S.C. 154(b) by 139 days.

(21) Appl. No.: 14/182,708

(22) Filed: Feb. 18, 2014

(65) Prior Publication Data

US 2015/0237426 A1 Aug. 20, 2015

(51) Int. Cl.
*H04R 1/02* (2006.01)

(52) U.S. Cl.
CPC ..... *H04R 1/02* (2013.01); *H04R 2499/11* (2013.01); *H04R 2499/15* (2013.01)

(58) Field of Classification Search
CPC .... H04R 2205/021; H04R 5/02; H04R 1/005; H04R 1/02; H04R 1/10; H04R 1/403; H04R 1/406
USPC ..... 381/334
See application file for complete search history.

(56) References Cited

U.S. PATENT DOCUMENTS 6,453,045 B1 9/2002 Zurek et al.
8,543,168 B2 9/2013 Zurek et al.
8,699,742 B2 4/2014 Heiman et al.
2006/0023898 A1* 2/2006 Katz ..... G10H 1/32 381/98
2009/0034759 A1* 2/2009 Ko ..... H04N 5/642 381/152
2012/0243719 A1 9/2012 Franklin et al.
2013/0308798 A1 11/2013 Lee

FOREIGN PATENT DOCUMENTS

JP 2007208948 A * 8/2007 ..... H04N 5/642

OTHER PUBLICATIONS

International Search Report and Written Opinion from corresponding application PCT/US2015/015594, dated May 13, 2015, 9 pages.
Kyocera Introduces Urbano Progresso, World's First Smartphone to Transmit Clear Voice Reception via Vibration of Display Screen, Kyocera and KDDI Corporation, http://global.kyocera.com/news/2012/0501_akgu.html, May 15, 2012, pp. 1-2.
Kyocera launches speakerless phone, uses vibrations to transmit sound to the ear, Jay Alabaster, http://www.computerworld.com/s/article/9227659/Kyocera_launches_speakerless_phone_uses_vibrations_to_transmit_sound_to_the_ear, May 31, 2012, p. 1.

* cited by examiner

*Primary Examiner* — Mark Blouin

(57) ABSTRACT

A method and system for providing a moving-screen sound system for a portable communication device such as a cell phone employs a fixed, pivoted, or hinged display screen driven directly or indirectly by an audio actuator. While the frequency response of the screen may have defects that would negatively impact overall sound quality from the device, in embodiments a supplemental audio transducer is placed adjacent the screen or elsewhere on the device so as to supplement or correct the frequency response of the screen. In an embodiment, the supplemental audio transducer is driven to correct a notch or other defect in the screen response. In another embodiment, the supplemental audio transducer is driven to extend the bass response of the screen.

20 Claims, 6 Drawing Sheets

SUPPLEMENTARY EARPIECE FOR MOVING DISPLAY

TECHNICAL FIELD

The present disclosure is generally related to audio reproduction for mobile computing devices and, more particularly, to providing a moving-screen audio transducer while allowing enhanced clarity and frequency response of the audio system.

BACKGROUND

Most mobile device users are aware that sophisticated hardware and software are used to drive their device display. However, far fewer users may realize that providing audio on such a device also raises daunting challenges. For users that employ earphones or headphones when listening to their device, the transduction of audio data into sound is left to the earphone or headphone manufacturer. However, for audio that needs to be projected directly from the device itself, e.g., during a hands-free call, the phone itself must be equipped for the transduction of audio data into sound.

Traditionally, mobile devices have employed simple speaker technology. However, the continuing decrease in device size and weight have lead to an alternative speaker technique, namely, the use of the device display glass itself as a speaker membrane or surface. While this may be referred to as a moving-screen technology, it might more accurately be considered a vibrating-screen technology; these terms may be used interchangeably herein.

In the moving-screen technique, the glass display acts as a transducer for an audio signal. This provides certain benefits, e.g., the user can place his ear essentially anywhere, during a hands-free or ordinary call, and still hear the conversation. However, there are also substantial drawbacks: Glass displays are designed primarily for visual display and not for audio transduction and thus do not inherently posses the properties required for high quality sound reproduction.

Thus, for example, a single transducer applied to a display screen tends to have an audio response characterized by acoustic peaks and valleys. In addition, this type of moving-screen technology often results in poor reproduction of low-frequency audio. Moreover, since the display-screen production process is not adapted to test or control audio-response characteristics, there is substantial variation in frequency response from screen to screen. While these shortcomings can manifest themselves in the form of poor audio quality from the user's standpoint, they may also be severe enough to prevent industry certification or approval of the device.

It will be appreciated that this Background section represents the observations of the inventors, and these observations are provided simply as a research guide to the reader. As such, nothing in this Background section is intended to represent, or to fully describe, any particular prior art.

BRIEF DESCRIPTION OF THE SEVERAL VIEWS OF THE DRAWINGS

While the appended claims set forth the features of the present techniques with particularity, these techniques, together with their objects and advantages, may be best understood from the following detailed description taken in conjunction with the accompanying drawings of which:

DETAILED DESCRIPTION

Before providing a detailed discussion of the figures, a brief overview is given to guide the reader. In an embodiment, an audio-transducer system includes a first transducer formed with the display glass of a device and a second dynamic audio transducer near the top of the device. The second transducer supplements the sound output of the device while also compensating for frequency anomalies of the glass structure. Not only does this system provide an improved user experience, but it also allows the device to achieve adequate frequency response for Type Approval. In an embodiment, the second dynamic audio transducer is equalized so that the sum of its response and the glass's response meet the required mask.

In an embodiment, the display movement near the perimeter is limited. In a further embodiment, the dynamic audio transducer is used to fill in notches in the glass response or to extend the bass response.

Turning now to a more detailed discussion in conjunction with the attached figures, techniques of the present disclosure are illustrated as being implemented in a suitable environment. The following description is based on embodiments of the disclosed principles and should not be taken as limiting the claims with regard to alternative embodiments that are not explicitly described herein.

Figure 1:
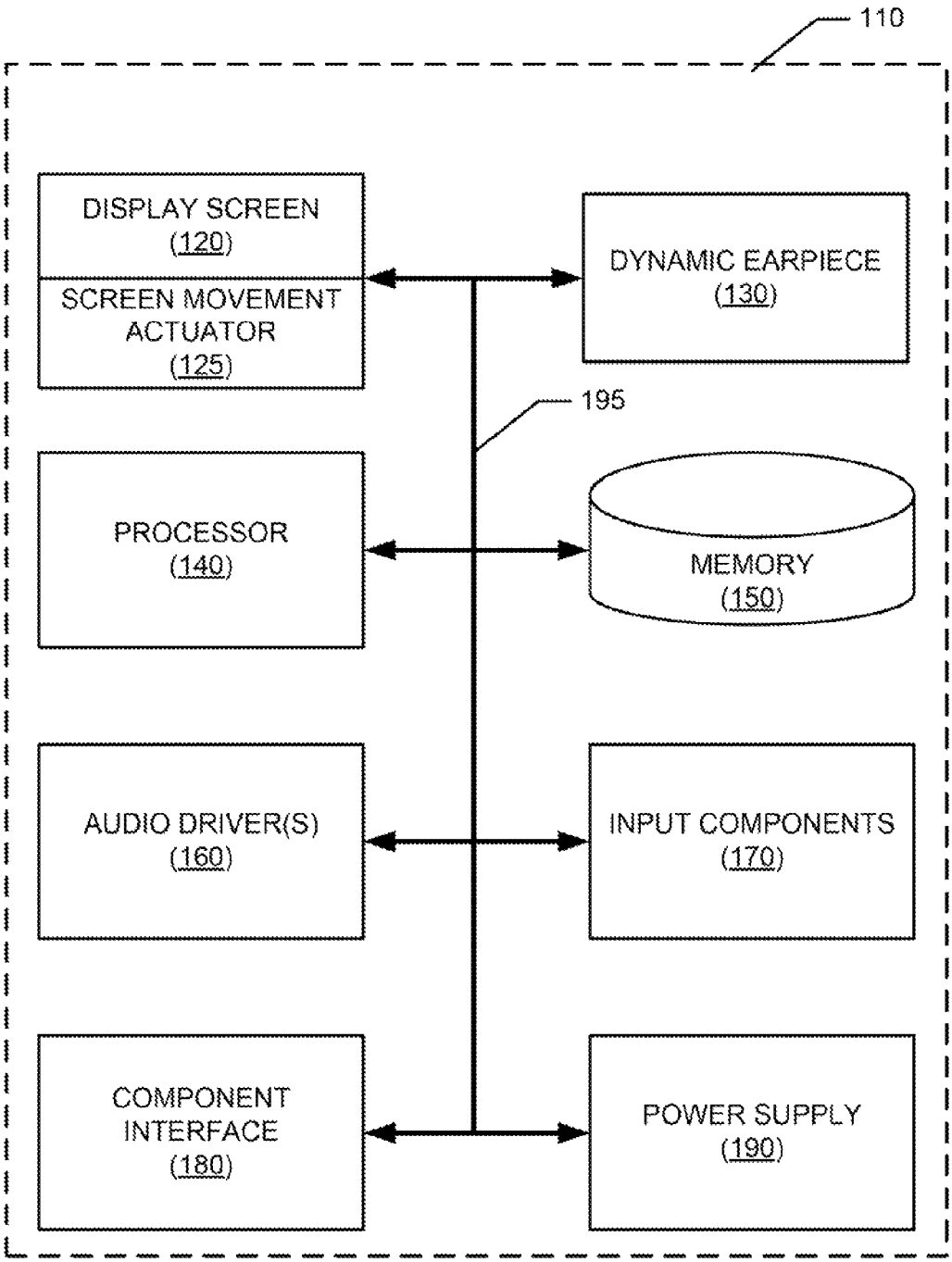
FIG. 1 is a schematic diagram of a mobile computing device such as a smart phone, cell phone, etc., within which embodiments of the disclosed principles may be implemented.

The schematic diagram of FIG. 1 shows an exemplary device within which aspects of the present disclosure may be implemented. In particular, the schematic diagram illustrates a user device 110 including several exemplary components. It will be appreciated that additional or alternative components may be used in a given implementation depending upon user preference, cost, and other considerations.

In the illustrated embodiment, the components of the user device 110 include a display screen 120 having associated therewith a display-screen audio actuator 125. These elements are discussed in greater detail later with reference to other figures. A dynamic audio transducer 130 is also included in the illustrated embodiment. The user device 110 further incorporates a processor 140, a memory 150, one or more audio drivers 160, and one or more input components 170.

The processor 140 can be any of a microprocessor, microcomputer, application-specific integrated circuit, or the like. For example, the processor 140 can be implemented by one or more microprocessors or controllers from any desired family or manufacturer. Similarly, the memory 150 may reside on the same integrated circuit as the processor 140. Additionally or alternatively, the memory 150 may be accessed via a network, e.g., via cloud-based storage. The memory 150 may include a random-access memory. Additionally or alternatively, the memory 150 may include a read-only memory (i.e., a hard drive, flash memory, or any other desired type of memory device).

The information that is stored by the memory 150 can include code associated with one or more operating systems or applications as well as informational data, e.g., program parameters, process data, etc. The operating system and applications are typically implemented via executable instructions stored in a non-transitory computer-readable medium (e.g., memory 150) to control basic functions of the electronic device 110. Such functions may include, for example, interaction among various internal components and storage and retrieval of applications and data to and from the memory 150.

The device 110 may also include a component interface 180 to provide a direct connection to auxiliary components or accessories and a power supply 190, such as a battery, for providing power to the device components. In an embodiment, all or some of the internal components communicate with one another by way of one or more internal communication links 195, such as an internal bus.

Further with respect to the applications, these typically utilize the operating system to provide more specific functionality, such as file-system service and handling of protected and unprotected data stored in the memory 150. Although many applications may govern standard or required functionality of the user device 110, in many cases applications govern optional or specialized functionality, which can be provided, in some cases, by third-party vendors unrelated to the device manufacturer.

Finally, with respect to informational data, e.g., program parameters and process data, this non-executable information can be referenced, manipulated, or written by the operating system or an application. Such informational data can include, for example, data that are preprogrammed into the device 110 during manufacture, data that are created by the device 110, or any of a variety of types of information uploaded to, downloaded from, or otherwise accessed at servers or other devices with which the device 110 is in communication during its ongoing operation.

In an embodiment, the device 110 is programmed such that the processor 140 and memory 150 interact with the other components of the device 110 to perform a variety of functions. The processor 140 may include or implement various modules and execute programs for initiating different activities such as launching an application, transferring data, and toggling through various graphical user-interface objects (e.g., toggling through various icons that are linked to executable applications).

Figure 2:
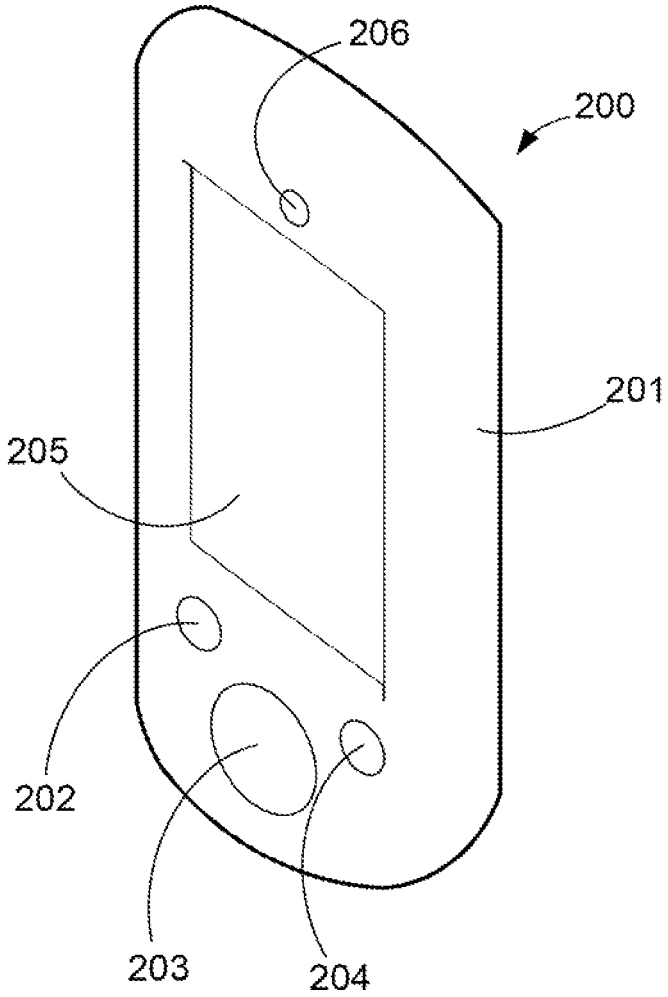
FIG. 2 is a perspective front view of a mobile computing device such as that shown in FIG. 1.

FIG. 2 presents a simplified perspective illustration of an example user device 200 within which embodiments of the disclosed principles may be implemented. As shown, the user device 200 generally includes a body or case 201 that allows a user to hold and handle the device 200. In addition, the case 201 serves to protect the internal components of the device 200 and to provide an anchor for external interface ports and components such as headphone jacks and hardware buttons 202, 203, 204.

The illustrated device also includes a display screen 205, which is a touch screen in an embodiment. Although not visible in FIG. 2, the display screen 205 is movable, e.g., via its inherent flexibility or through a hinged or other movable attachment to the case 201. An audio actuator, also not visible in FIG. 2, is linked to an underside of the display screen 205. The audio actuator may be affixed directly to the underside of the display screen 205 or may be attached to a link or lever that is itself attached to or otherwise in contact with the display screen 205.

As shown in FIG. 2, the illustrated device 200 also includes a speaker outlet 206. The speaker outlet 206 provides a port usable by a sound source (not visible in FIG. 2) to project sound out of the device 200. The sound source may include one or more individual sources and may employ a dynamic speaker or another type of sound source.

Figure 3:
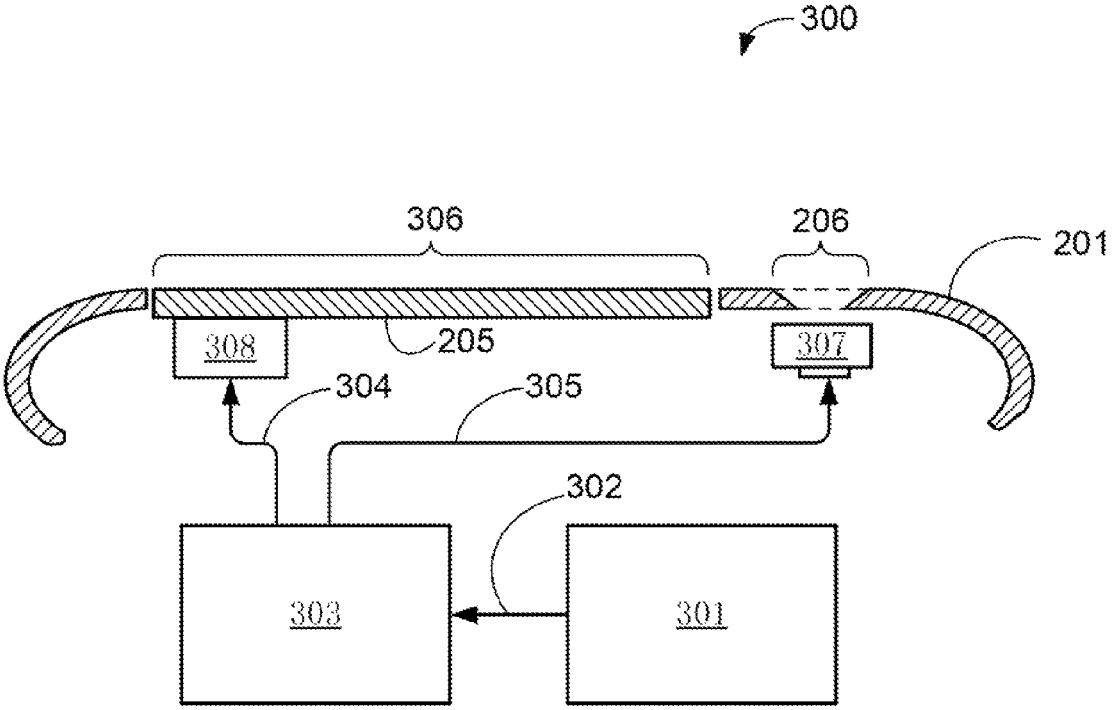
FIG. 3 is a partial cross-sectional view of a device in accordance with an embodiment of the disclosed principles.

Within the context of a device such as that described with reference to FIGS. 1 and 2, or a similar device having a display as well as audio capabilities, FIG. 3 illustrates in greater detail a simplified schematic of an audio transduction system in accordance with the disclosed principles. In particular, FIG. 3 shows a simplified schematic illustration of an exemplary audio system of such a device.

In the illustrated embodiment, the audio system 300 includes an audio decoding or decompression module 301. The decoding or decompression module 301 provides a digital input 302 to an audio-driver module 303 which creates one or more driving signals 304, 305. While the driving signals 304, 305 are shown in FIG. 3 as one-way signals, it will be appreciated by those of skill in the art that the audio-driver module 303 may be capable of monitoring impedance to further adjust its output. The driving signals 304, 305 drive a plurality of audio transducers 306, 307 respectively.

In an embodiment, the first audio transducer 306 comprises a moving-screen transducer comprising an actuator 308 and a screen 205, which may be the display screen of the host device. The actuator 308 may be of any suitable type capable of causing a vibration of the screen 205 at human-audible frequencies and suitable amplitudes. Suitable actuators include piezo-electric actuators, electromagnetic actuators, and the like.

In an embodiment, the driving signals 304, 305 convey essentially identical audio data, with the exception of possible differences in the format, amplitude, and frequency envelope of the data. For example, depending upon the actuators used, the first driving signal 304 may be a current signal with an amplitude and envelope configured to drive an electromagnetic actuator 308 affixed to a screen 205, the system having a response notch in the middle of the audible range. In contrast, the second driving signal 305 may be a voltage signal with an amplitude and envelope configured to drive an isolated piezo actuator having a flat response. Nevertheless, the outputs of the first and second transducers 306, 307 may sound essentially the same to the user, with minor differences in overall amplitude and frequency response. It will be appreciated that there is no requirement for any signal to be of any particular type, e.g., voltage or current, and that the foregoing examples are simply given for illustrative purposes.

In an alternative embodiment, the driving signals 304, 305 are identical, and are thus not configured to account for the frequency response of the relevant transducers 306, 307.

As noted above, the combined frequency response of a screen and its actuator may be inherently poor. For example, this system may have significant notching in its frequency response. Furthermore, the placement of the screen against the user's cheek during a call may also affect the system's frequency response, e.g., by damping certain frequencies or frequency ranges.

To this end, in an embodiment, the second transducer 307 is an electrodynamic speaker, that is, a speaker that uses a driven coil to move a coil or magnet that is connected to a diaphragm (e.g., a speaker cone). The driven coil is selectively energized within a magnetic field to oscillate the speaker cone in a manner that reproduces a sound of interest.

The magnetic field may be provided by a permanent magnet or by a field coil. In a further embodiment the electrodynamic speaker is driven in a manner calculated to at least partially offset frequency notches in the response of the screen 205 (acting as part of the audio transducer 306).

Figure 4:
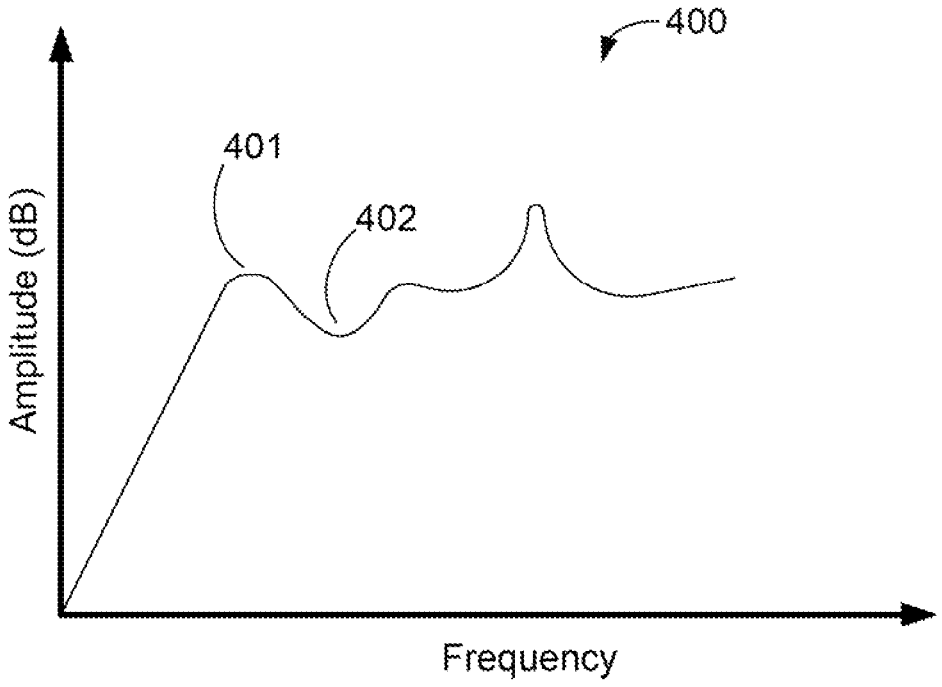
FIG. 4 is a frequency-response plot of a first audio transducer usable within an embodiment of the disclosed principles.

FIG. 4 is a simulated response plot 400 showing a possible frequency response of a driven display screen, that is, the system's response to an excitation wave of constant amplitude that is swept through the relevant frequency range. As can be seen, in the illustrated example the frequency response of the screen is irregular, showing poor bass response 401 and a notch 402 that would affect the user-perceived sound quality. Not shown in FIG. 4 are additional notches and peaks typically associated with driven displays. These artifacts in the response would also likely be considered sufficient to prevent type of approval of the system.

Figure 5:
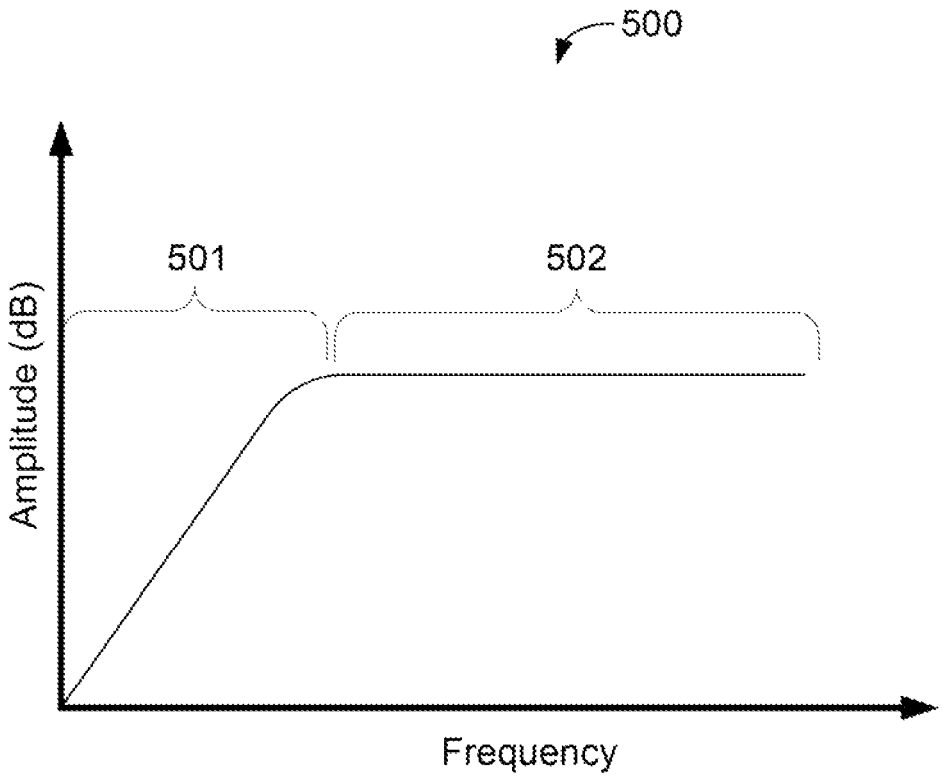
FIG. 5 is a frequency-response plot of a second audio transducer usable within an embodiment of the disclosed principles.

Continuing, FIG. 5 is a simulated response plot 500 showing a possible frequency response of the second transducer 307, which as noted above may be an electrodynamic speaker. As can be seen in the illustrated example, the response of the second transducer 307 conforms to a standard smooth response curve, with a roll-on region 501 from the low-frequency cut off and a relatively flat midrange response region 502.

While the pleasant response of the second transducer 307 may somewhat mask the poor response of the first transducer 306, the defects in the response of the screen-based first transducer 306 may still be audible. To that end, in an embodiment, the response of the second transducer 307 is artificially modified to offset the defects in the response of the first transducer 306.

Figure 6:
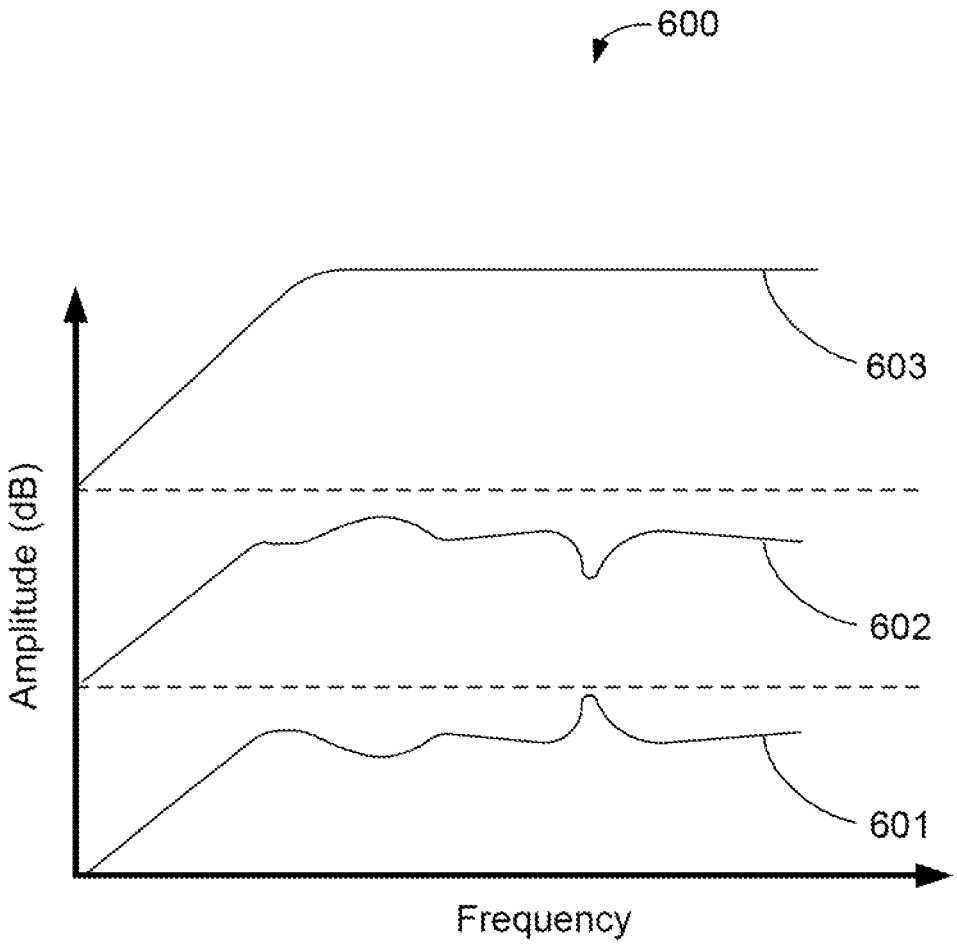
FIG. 6 is a frequency-response plot showing a frequency-response plot of the first audio transducer, a modified frequency response of the second audio transducer, and a combined frequency response in keeping with an embodiment of the disclosed principles.

FIG. 6 shows a set 600 of example plots, including a first plot 601 corresponding to the response of the first transducer 306, a second plot 602 corresponding to the response of the second transducer 307, and a third plot 603 corresponding to the combined response of both transducers 306, 307. In the illustrated example, the frequency response 602 of the second transducer 307 has been modified, by selective scaling or other techniques, to offset the response 601 of the first transducer 306, such that the combined response from the transducers 306, 307 is as shown in response 603. In particular, the combined response 603 is smooth with no significant peaks or notches that would disrupt the user experience.

In an embodiment, the modification of the response of the second transducer 307 is performed via a mapping executed before the communications device is sold at retail. In a further embodiment, a user may perform an initial or subsequent mapping using an application or function loaded on the device. Depending upon the consistency of response among various screen-based transducers such as transducer 306, it is also possible for the same response mapping to be applied by the manufacturer on each device that uses the same screen.

In an embodiment, one or both transducers 306, 307 are selectively disabled depending upon the usage mode of the device. For example, during a hands-free call, both transducers 306, 307 may be active. However, when the device is held to the user's ear during a call, the first transducer 306 may be disabled. In addition, the sound volume from the second transducer 307 may be reduced in this situation.

In an embodiment, the second transducer 307 is equalized so that the sum of its response and the glass's response meet a specified mask. In another embodiment, the display movement near the perimeter is limited. In yet another embodiment, the second transducer 307 is used to extend the bass response of the device. Although the examples given show the second transducer 307 on the front face of the device near the top, the second transducer 307 may be placed at another location if desired. Further, a third, fourth, or subsequent transducer may also be used without departing from the scope of the disclosed principles.

It will be appreciated that the disclosed principles allow the use of a screen-based transducer to produce sound with respect to a mobile device, while also allowing the manufacturer to provide acceptable frequency response for the device as a whole. However, in view of the many possible embodiments to which the principles of the present discussion may be applied, it should be recognized that the embodiments described herein with respect to the drawing figures are meant to be illustrative only and should not be taken as limiting the scope of the claims. Therefore, the techniques as described herein contemplate all such embodiments as may come within the scope of the following claims and equivalents thereof.

I claim:

1. A portable communication device having enhanced audio capability, the device comprising:

a body of the device;

a first audio transducer comprising a display screen exposed on a face of the device and linked to the body of the device and an actuator coupled to the display screen;

a second audio transducer including a speaker fixed to the body of the device; and an audio driver configured to drive the first audio transducer and the second audio transducer simultaneously, the audio driver being further configured to drive the second audio transducer based on a frequency response map of the first audio transducer to, at least, compensate for a notch in the frequency response map.

2. The portable communication device of claim 1 further comprising a processor for controlling the audio driver.

3. The portable communication device of claim 1 wherein the display screen has a perimeter edge and wherein the perimeter edge is stationarily attached to the body of the device.

4. The portable communication device of claim 1 wherein the display screen has a perimeter edge and wherein a portion of the perimeter edge is hindgedly attached to the body of the device.

5. The portable communication device of claim 1 wherein the second audio transducer includes an electrodynamic speaker.

6. The portable communication device of claim 1 wherein the first audio transducer has a frequency response spectrum that includes defects in a human-audible range and wherein driving the second audio transducer based on the frequency response map of the first audio transducer includes driving the second audio transducer to substantially attenuate the defects.

7. The portable communication device of claim 1 wherein the first audio transducer exhibits a bass response and wherein driving the second audio transducer based on the frequency response map of the first audio transducer includes driving the second audio transducer to augment the bass response of the first audio transducer.

8. The portable communication device of claim 1 wherein the actuator of the first audio transducer is coupled directly to the display screen.

9. The portable communication device of claim 1 wherein the actuator of the first audio transducer is coupled indirectly to the display screen via an intermediate structure.

10. The portable communication device of claim 9 wherein the intermediate structure is one of a link and a lever.

11. The portable communication device of claim 1 wherein the actuator of the first audio transducer includes one of a piezo-electric actuator and an electromagnetic actuator.

12. A sound system for a portable communication device, the sound system comprising:

a first audio transducer including a first audio actuator and a display screen, the first audio actuator being coupled to the display screen so as to cause audible vibration of the display screen when driven;

a second audio transducer including an electrodynamic speaker; and an audio driver configured to drive emission of a sound from the first audio transducer and the second audio transducer simultaneously, the audio driver being further configured to drive the second audio transducer based on a frequency response map of the first audio transducer to, at least, compensate for a notch in the frequency response map.

13. The sound system of claim 12 further comprising a processor for controlling the audio driver.

14. The sound system of claim 12 wherein the display screen has a perimeter edge configured for stationary attachment to a body of the portable communication device.

15. The sound system of claim 12 wherein the display screen has a perimeter edge configured for hinged attachment to a body of the portable communication device.

16. The sound system of claim 12 wherein the first audio transducer has a frequency spectrum including defects in a human-audible range and wherein driving the second audio transducer based on the frequency response map of the first audio transducer includes driving the second audio transducer to substantially attenuate the defects.

17. The sound system of claim 12 wherein the first audio transducer exhibits a bass response and wherein driving the second audio transducer based on the frequency response map of the first audio transducer includes driving the second audio transducer to augment the bass response of the first audio transducer.

18. The sound system of claim 12 wherein the first audio actuator is coupled to the display screen via one of a link and a lever.

19. The sound system of claim 12 wherein the first audio actuator is one of a piezo-electric actuator and an electromagnetic actuator.

20. A method of enhancing an audio quality associated with a portable communications device having a moving-screen audio transducer, the method comprising:

placing an electrodynamic speaker element within a case of the portable communications device, the case having an opening for release of sound from the electrodynamic speaker element; and driving the moving-screen audio transducer and the electrodynamic speaker element simultaneously, the electrodynamic speaker element being driven based on a frequency response map of the moving-screen audio transducer to, at least, compensate for a notch in the frequency response map such that sound emitted from the electrodynamic speaker element enhances sound emitted from the moving-screen audio transducer.

* * * * *